US010622706B2

(12) United States Patent
Moon et al.

(10) Patent No.: US 10,622,706 B2
(45) Date of Patent: Apr. 14, 2020

(54) MOBILE COMMUNICATION BASE STATION ANTENNA

(71) Applicant: KMW INC., Hwaseong-si (KR)

(72) Inventors: Young-Chan Moon, Suwon-si (KR); Sung-Hwan So, Hwaseong-si (KR); Soon-Wook Kim, Yongin-si (KR); Jae-Hwan Lim, Seoul (KR); Seong-Ha Lee, Inchoen-si (KR)

(73) Assignee: KMW INC., Hwaseong-si (KR)

( * ) Notice: Subject to any disclaimer, the term of this patent is extended or adjusted under 35 U.S.C. 154(b) by 0 days.

(21) Appl. No.: 15/592,156

(22) Filed: May 10, 2017

(65) Prior Publication Data

US 2017/0244159 A1 Aug. 24, 2017

Related U.S. Application Data

(63) Continuation of application No. PCT/KR2015/012057, filed on Nov. 10, 2015.

(30) Foreign Application Priority Data

Nov. 11, 2014 (KR) ..... 10-2014-0156138

(51) Int. Cl.
*H01Q 1/24* (2006.01)
*H01Q 9/04* (2006.01)
(Continued)

(52) U.S. Cl.
CPC ..... *H01Q 1/246* (2013.01); *H01Q 1/46* (2013.01); *H01Q 5/42* (2015.01); *H01Q 9/0457* (2013.01); *H01Q 15/14* (2013.01)

(58) Field of Classification Search
CPC ..... H01Q 1/46; H01Q 1/246; H01Q 15/14; H01Q 9/065; H01Q 19/108; H01Q 9/0407; H01Q 21/24; H01Q 9/0457
See application file for complete search history.

(56) References Cited

U.S. PATENT DOCUMENTS 5,220,334 A * 6/1993 Raguenet ..... H01Q 1/362 343/700 MS
5,838,282 A * 11/1998 Lalezari ..... H01Q 21/26 343/727

(Continued)

FOREIGN PATENT DOCUMENTS

CN 101069324 B 11/2007
CN 103367897 A 10/2013

(Continued)

OTHER PUBLICATIONS

Ryu et al.; "Wideband Dual-Polarized Microstrip Patch Excited by Hook Shaped Probes"; IEEE Transactions on Antennas and Propagation, vol. 56, No. 12, Dec. 2008 (Year: 2008).*

(Continued)

*Primary Examiner* — Ab Salam Alkassim, Jr.

(57) ABSTRACT

A mobile communication base station antenna includes: a reflecting plate; a first patch-type radiating element installed on the reflecting plate; a second dipole-type radiating element installed and stacked on the first radiating element; and a circuit board for feeding power installed on the same surface as a surface of the reflecting plate on which the first radiating element and the second radiating element are installed and having a conductive pattern formed thereon to provide a feeding signal to the first radiating element.

15 Claims, 10 Drawing Sheets

(51) Int. Cl.

| | |
|---|---|
| ***H01Q 5/42*** | (2015.01) |
| ***H01Q 1/46*** | (2006.01) |
| ***H01Q 15/14*** | (2006.01) |

(56) References Cited

U.S. PATENT DOCUMENTS 5,896,107 A * 4/1999 Huynh ..... H01Q 9/0435 343/700 MS
5,909,195 A * 6/1999 Merenda ..... H01Q 9/26 343/815
7,068,222 B2 * 6/2006 Koparan ..... H01Q 1/246 343/700 MS
7,283,101 B2 * 10/2007 Bisiules ..... H01Q 1/246 343/700 MS
9,325,071 B2 * 4/2016 Fasenfest ..... H01Q 9/045
9,450,305 B2 * 9/2016 Puente ..... H01Q 1/246
2003/0011529 A1 * 1/2003 Gottl ..... H01Q 1/246 343/795
2004/0027292 A1 * 2/2004 Gabriel ..... H01Q 9/0414 343/700 MS
2006/0114168 A1 * 6/2006 Gottl ..... H01Q 1/246 343/797
2008/0024382 A1 * 1/2008 Uddin ..... H01Q 1/526 343/841
2009/0046026 A1 * 2/2009 Nakano ..... H01Q 7/00 343/741
2010/0265150 A1 * 10/2010 Arvidsson ..... H01Q 1/246 343/837
2010/0302104 A1 * 12/2010 Luk ..... H01Q 9/0435 343/700 MS
2011/0175784 A1 * 7/2011 Moon ..... H01Q 9/16 343/816
2014/0198014 A1 * 7/2014 Fasenfest ..... H01Q 9/045 343/906
2015/0042513 A1 * 2/2015 Foo ..... H01Q 1/246 342/368
2015/0200460 A1 * 7/2015 Isom ..... H01Q 9/0407 343/853
2015/0263431 A1 * 9/2015 Moon ..... H01Q 1/246 343/730
2015/0357714 A1 * 12/2015 Ng ..... H01Q 1/48 343/848
2015/0381229 A1 * 12/2015 Tzanidis ..... H01Q 1/50 455/73
2017/0012364 A1 * 1/2017 Yang ..... H01Q 1/246
2017/0170567 A1 * 6/2017 Luo ..... H01Q 9/0407
2017/0324163 A1 * 11/2017 Foo ..... H01Q 1/246
2017/0331184 A1 * 11/2017 Langenberg ..... H01Q 1/22
2018/0261929 A1 * 9/2018 Biscontini ..... H01Q 1/246
2019/0044238 A1 * 2/2019 Schuhler ..... H01Q 1/38
2019/0312338 A1 * 10/2019 Guntupalli ..... H01Q 1/48

FOREIGN PATENT DOCUMENTS

| | | | | |
|---|---|---|---|---|
| JP | 2001-196846 | A | 7/2001 | |
| JP | 2013-510537 | A | 3/2013 | |
| KR | 10-2011-0054150 | A | 5/2011 | |
| KR | 10-2012-0086842 | A | 8/2012 | |
| KR | 10-2013-0102171 | A | 9/2013 | |
| KR | 10-2014-0069968 | A | 6/2014 | |
| WO | 1999/59223 | A2 | 11/1999 | |
| WO | WO 9959223 | A2 * | 11/1999 | ..... H01Q 1/246 |
| WO | WO-9959223 | A2 * | 11/1999 | ..... H01Q 1/246 |
| WO | 2006/059937 | A1 | 6/2006 | |

OTHER PUBLICATIONS

Wong et al.; "Design of Dual-Polarized L-Probe Patch Antenna Arrays with High Isolation"; IEEE Transactions on Antennas and Propagation, vol. 52, No. 1, Jan. 2004 (Year: 2004).*
International Search Report for PCT/KR2015/012057, dated Feb. 19, 2016, and its English translation.
Ryu, Wideband Dual-Polarized Microstrip Patch Excited by Hook Shaped Probes, IEEE Transactions on Antennas and Propagations, vol. 56, No. 12, Dec. 2008.
Chinese office action for Chinese Application No. 2015/80060687.0 dated Jul. 19, 2019.

* cited by examiner

MOBILE COMMUNICATION BASE STATION ANTENNA

CROSS REFERENCE TO RELATED APPLICATIONS

This application is a continuation of International Application No. PCT/KR2015/012057 filed on Nov. 10, 2015, which claims priority to Korean Application No. 10-2014-0156138 filed on Nov. 11, 2014, the entire contents of which are herein incorporated by reference in its entirety.

TECHNICAL FIELD

The present invention relates to a mobile communication base station antenna used in a mobile communication system, and more particularly, to a mobile communication base station antenna suitable for use in an antenna having a dual-band dual-polarization structure.

BACKGROUND ART

A base station antenna including a repeater used in a mobile communication system may have various shapes and structures. Typically, the base station antenna has a structure in which a plurality of radiating elements are appropriately disposed on at least one reflecting plate standing upright in the longitudinal direction.

Recently, a variety of studies have been conducted in order to satisfy the demand for miniaturization and weight reduction of a base station antenna. Among them, in the case of a dual-band dual-polarized antenna, for example, an antenna having a structure in which a second radiating element in a high frequency band of a next-generation advanced wireless service (AWS) band or a 2 GHz band is stacked on a first radiating element in a low frequency band of 700/800 MHz band is being developed.

The antenna may have the first and second radiating elements having, for example, a stacked structure in which a patch-type or dipole-type second radiating element is installed on a patch-type first radiating element. The first and second radiating elements having the stacked structure may have a structure in which a plurality of radiating elements are arranged on the reflecting plate at intervals to satisfy the arrangement of the radiating elements in the first frequency band.

Further, the antenna has a structure in which the second radiating elements are additionally installed on the reflecting plate to satisfy the arrangement of the radiating elements in the second frequency band between the first and second radiating elements having the stacked structure in which a plurality of radiating elements are installed. By the arrangement, it is possible to obtain an antenna gain while satisfying the miniaturization on the whole.

FIG. 1 is a plan view of the existing dual-band dual polarized mobile communication base station antenna, and FIG. 2 is a cross-sectional view taken along the line A-A' in FIG. 1. Referring to FIGS. 1 and 2, in the antenna having the structure in which the second radiating element is stacked on the first radiating element, patch-type first radiating elements 11 and 12 of a first frequency band (for example, 700/800 MHz band) are arranged at regular intervals on an upper surface of a reflecting plate 1. Further, the dipole-type second radiating elements 21, 22, 23, and 24 of the second frequency band (for example, the AWS band) are stacked on the first radiating elements 11 and 12 or is directly installed on the upper surface of the reflecting plate 1 between the first radiating elements 11 and 12.

Each of the first radiating elements 11 and 12 is made up of upper patch plates 11-2 and 12-2 and lower patch plates 11-1 and 12-1. The lower patch plates 11-1 and 12-1 are connected to a circuit board 111 on which a feeding conductor pattern attached to a back surface of the reflecting plate 1 is formed, by a feeding cable 112 passing through the reflecting plate 1. Further, the second radiating elements 21 and 22 stacked on the first radiating elements 11 and 12 are connected to a feeding network by a feeding cable 212 passing through the reflecting plate 1 and upper and lower patch plates 11-1 and 12-1 of the installed first radiating elements 11 and 12.

In addition, the base station antenna may include a cylindrical radome (not shown) completely enclosing the reflecting plate 1 on which the radiating elements are installed and various signal processing equipments for processing transmission/reception signals therein and an upper cap and a lower cap (not shown) for fixing upper and lower portions of the reflecting plate 1, respectively and sealing upper and lower openings of the cylindrical radome.

Meanwhile, FIGS. 3A-3B are views showing a feeding structure of the first radiating elements of FIG. 1. FIG. 3A is a plan view and FIG. 3B is a rear view. For convenience of explanation, FIGS. 3A-3B show one lower patch plate 11-1 of the first radiating elements and the circuit board 111 for the feeding conductor pattern is a lower patch plate 11-1 and a circuit board 111, and other components will be omitted. Referring to FIGS. 1 to 3B, the lower patch plate 11-1 of the first radiating element 11 is connected to the circuit board 111 attached to the back surface of the reflecting plate 1 by the feeding cable 112 passing through the reflecting plate 1. That is, the feeding conductor pattern of the first radiating element is formed on the circuit board 111 in a printing manner, and has a structure in which feeding points a to d on the circuit board 111 and feeding points a to d on the lower patch plate 11-1 are connected to each other by the feeding cables 112.

At this time, for example, the feeding conductor pattern is formed on the circuit board 111 so that a transmission signal at the feeding point c located diagonally to the feeding point a has a phase retarded by 180°, compared to the feeding point a. Similarly, the transmission signal at the feeding point d located diagonally to the feeding point b also has a phase retarded by 180°, compared to the feeding point b. Therefore, the dual polarization orthogonal to each other is generated at the feeding points a and c and the feeding points b and d on the lower patch plate 11-1 of the first radiating element.

Meanwhile, the upper patch plate 11-2 of the first radiating element is installed to optimize radiation characteristic and is installed by a support (reference numeral 130 of FIG. 2, or the like) of a plastic material 130, or the like so as to be insulated from the lower patch plate 11-1.

As a technique related to the base station antenna having the above-described structure, there is disclosed in Korean Patent Application No. 10-2009-0110696 (Title: Method for installing radiator elements arranged in different planes and antenna thereof, Inventors: four besides Yeon Chan Moon, Filing date: Nov. 17, 2009) earlier filed by the present applicant.

By the way, as disclosed in the above-mentioned Patent Application No. 10-2009-0110696, the structure in which the dipole-type second radiating element 21 is stacked on the patch-type first radiating element 11 has a relatively complicated and a relatively large number of additional accessories for supporting and fixing the first radiating element 11 and the second radiating element 21 are required. Further, in this case, the circuit board 111 for feeding power to the patch-type first radiating element 11 is installed on the back surface of the reflecting plate 1, and a feeding line (for example, feeding cable) of the second radiating element 21 stacked on the first radiating element 11 needs to be installed in a form in which it passes through the circuit board 111 again, or the like, and as a result a space required to install the feeding line on the back surface of the reflecting plate 1 is relatively large. In addition, the installation space of various signal processing equipments including a phase shifter, or the like that is provided on the back surface of the reflecting plate 1 may be limited. As a result, there has been a problem in that the overall size of the base station antenna becomes large.

DISCLOSURE

Technical Problem

An object of the present invention to provide a mobile communication base station antenna capable of more simplifying a structure in which a dipole-type radiating element is stacked on a patch-type radiating element, and in particular, optimizing a structure of the overall antenna by improving a feeding structure.

Technical Solution

In one general aspect, A mobile communication base station antenna, includes: a reflecting plate; a patch-type first radiating element installed on the reflecting plate; a dipole-type second radiating element installed to be stacked on the first radiating element; and a circuit board for feeding installed on the same surface as a surface on which the first radiating element and the second radiating element on the reflecting plate are installed and provided with a feeding conductor pattern for providing a feeding signal to the first radiating element.

Advantageous Effects

As described above, the mobile communication base station antenna according to the embodiments of the present invention may stack the dipole-type radiating element on the patch-type radiating element, with the very simply structure and expand the space utilization of the back surface of the reflecting plate by improving the feeding structure, thereby optimizing the structure of the overall antenna.

BEST MODE

Figure 1:
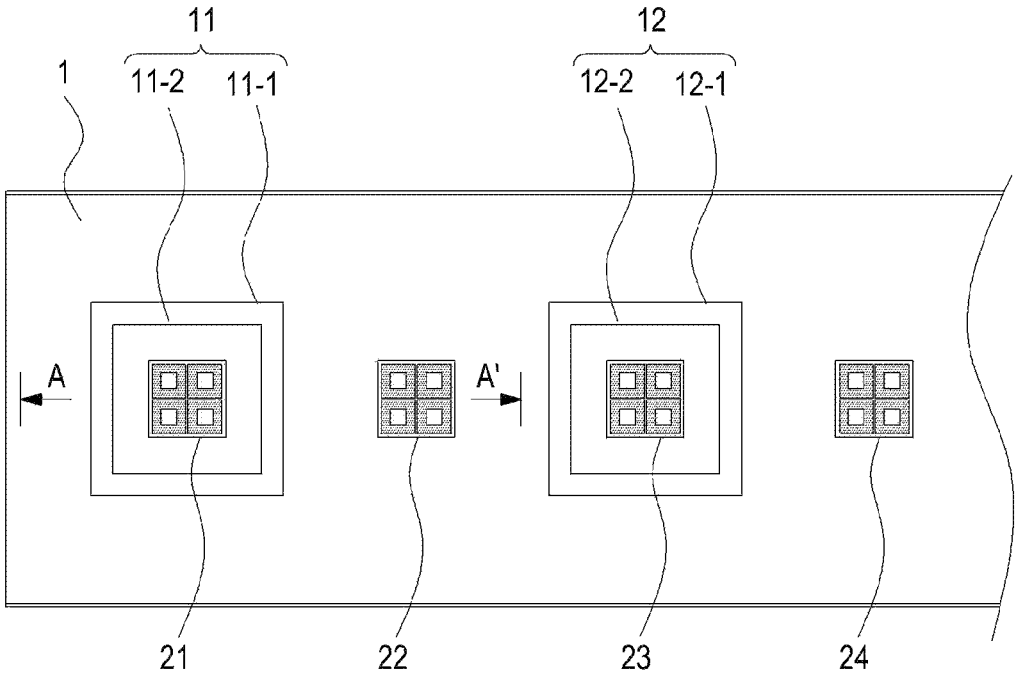
FIG. 1 (PRIOR ART)
FIG. 1 is a plan view of an example of the existing dual-band dual polarization mobile communication base station antenna.
Figure 2:
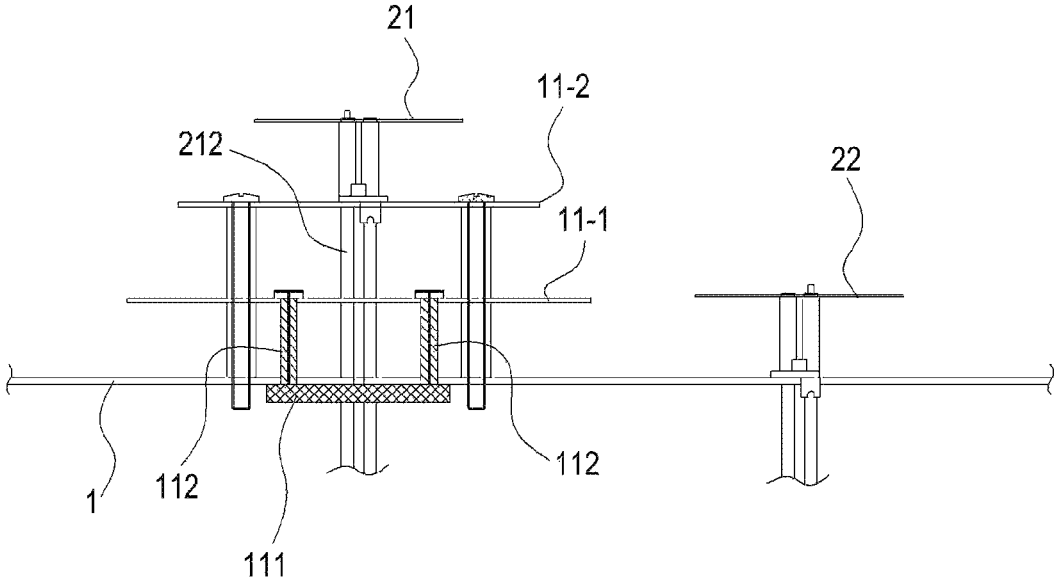
FIG. 2 (PRIOR ART)
FIG. 2 is a cross-sectional view taken along line A-A' of FIG. 1.
Figure 3A:
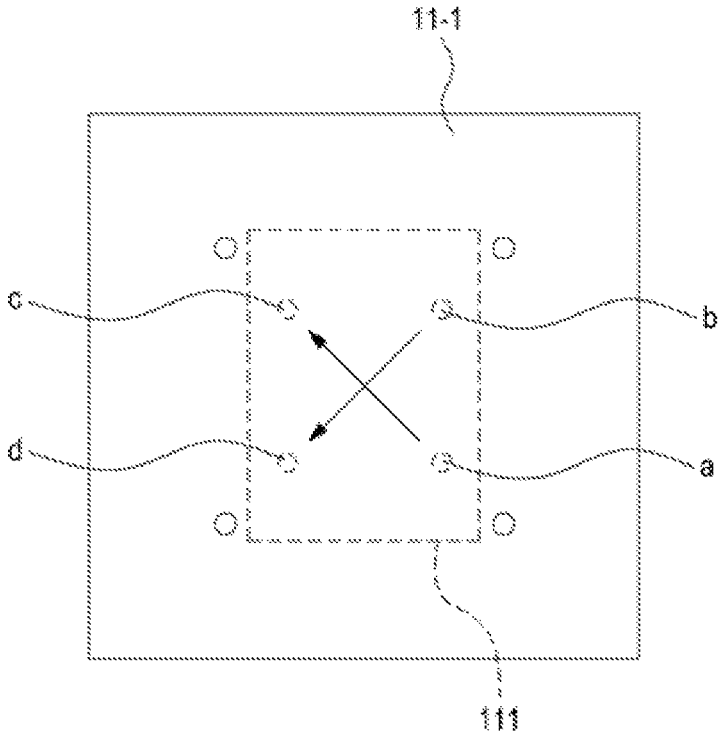
FIG. 3A (PRIOR ART)
FIGS. 3A and 3B are a plan view and a rear view showing a feeding structure of first radiating elements of FIG. 1.
Figure 3B:
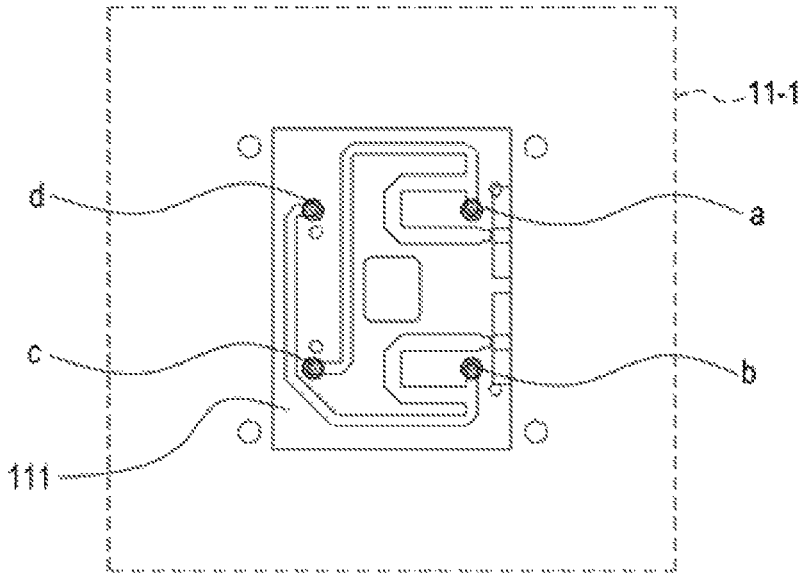
FIG. 3B (PRIOR ART)

Hereinafter, embodiments of the present invention will be described in detail with reference to the accompanying drawings. Specific matters such as specific components will be described below, which are provided only for a better understanding of the present invention. Accordingly, it will be apparent to those skilled in the art that the specific matters can be variously modified and changed without departing from the spirit or scope of the invention. In addition, like reference numerals are used to denote like elements in the accompanying drawings.

Figure 4:
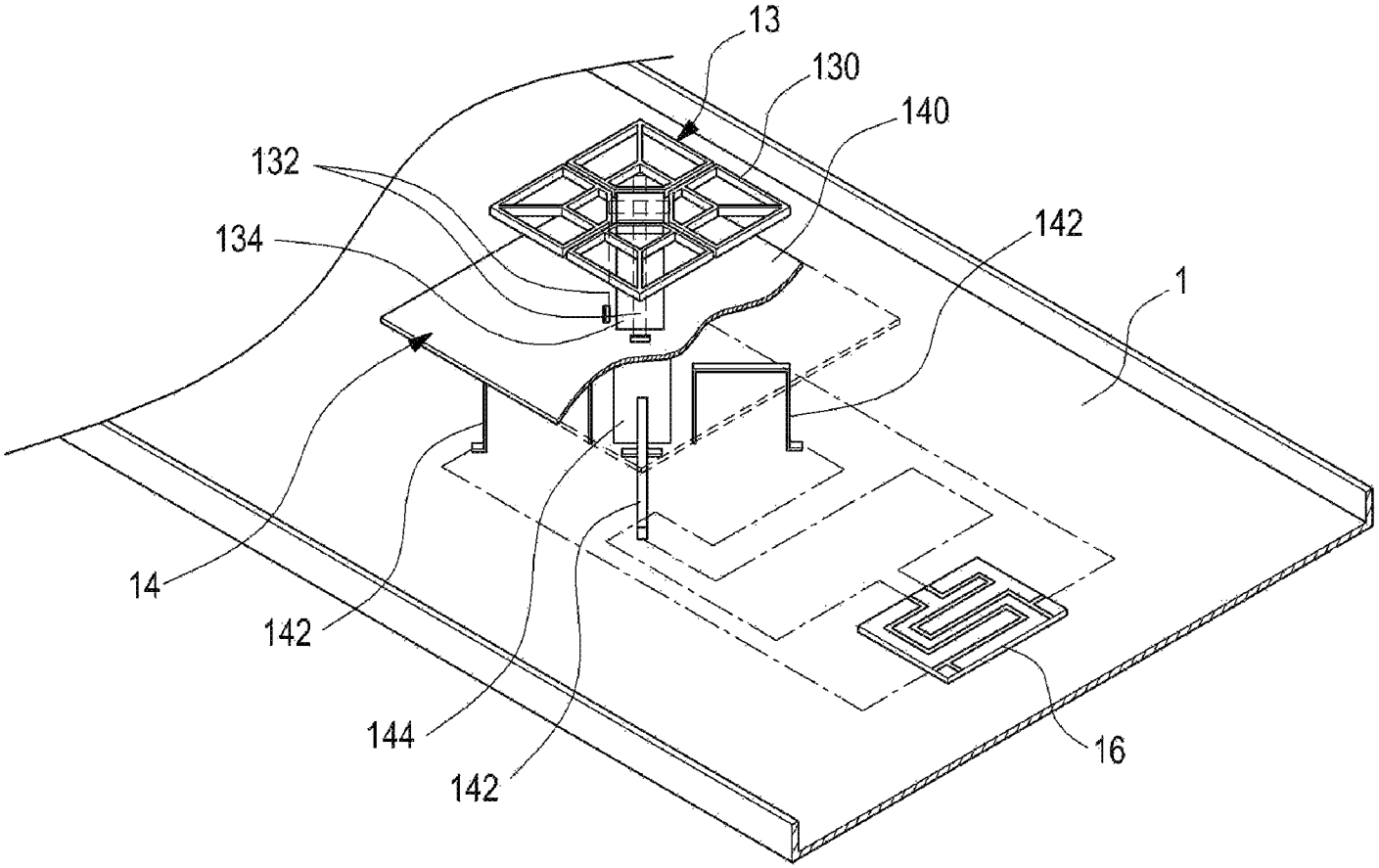
FIG. 4 is a perspective view of a dual-band dual-polarized mobile communication base station antenna according to a first embodiment of the present invention.
Figure 5:
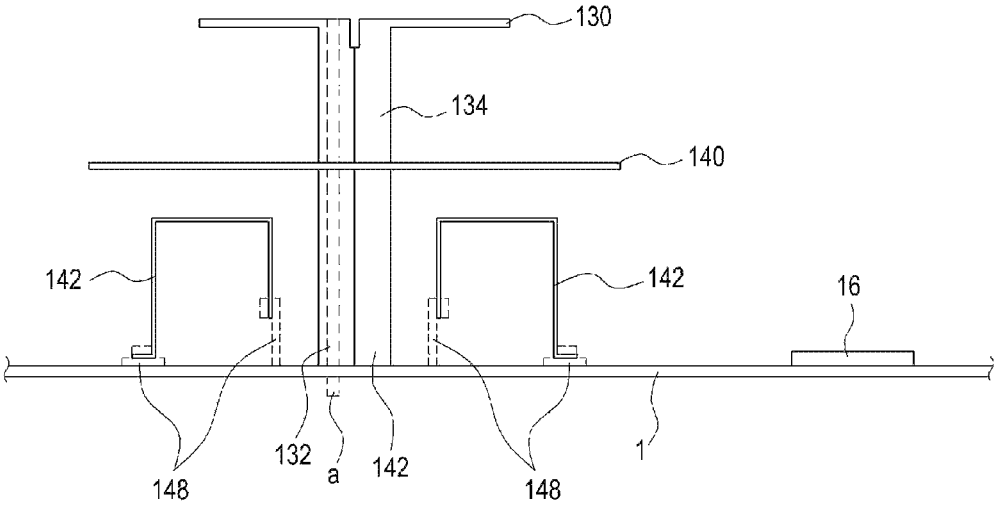
FIG. 5 is a side view of FIG. 4.

FIG. 4 is a perspective view of a dual-band dual-polarized mobile communication base station antenna according to a first embodiment of the present invention and FIG. 5 is a side view of FIG. 4. In FIGS. 4 and 5, for convenience of explanation, only one structure in which a dipole-type second radiating element 13 is stacked on a patch-type first radiating element 14 according to a first embodiment of the present invention. At this time, in addition, a dipole-type radiating element (not shown) may be directly installed on a reflecting plate 1 between the structures in which the radiating elements are stacked.

Referring to FIGS. 4 and 5, a base station antenna according to the first embodiment of the present invention includes a reflecting plate 1, a patch-type first radiating element 14 installed on the reflecting plate 1, a dipole-type second radiating element 13 stacked on the first radiating element 14, and balun supports 134 and 144 supporting the first radiating element 14 and the second radiating element 13.

The patch-type first radiating element 14 is designed to have a predetermined size for generating a radio frequency of a frequency band corresponding to, for example, a first frequency band among transmission frequency bands of the base station antenna and is configured to include a patch plate 140 formed in a rectangular plate of a metal material and a plurality of first feeding lines 142 for supplying a feeding signal to the patch plate 140, at a lower portion of the patch plate 140. The first feeding line 142 may have a strip line structure for coupling four or more feeding signals which are arranged in an X shape on the whole and provide a feeding signal to the patch plate 140 by a coupling method, respectively. To provide the feeding signal to the patch plate 140 by the coupling method, the strip lines for signal coupling that forms the plurality of first feeding lines 142 are installed to maintain a relatively high position on the reflecting plate 1 so that the corresponding coupling signal transmitting part is appropriately spaced apart from the patch plate 140. At this time, in order to support and fix an installed state of the strip lines for signal coupling, for example, an appropriate form of support 148 formed of a synthetic material such as Teflon is additionally installed.

The dipole-type second radiating element 13 is designed to include a plurality of radiation arms 130 having a predetermined structure for generating a radio frequency of a frequency band corresponding to, for example, the second frequency band among the transmission frequency bands of the base station antenna. The structure of the radiating arm 130 of the dipole-type second radiating element 13 may be configured to adopt various radiation arm structures applied to the typical dipole-type antennas as they are.

The balun supports 134 and 144 may be configured to be divided into a lower balun support 144 for supporting the patch-type first radiating element 14 and an upper balun support 134 for supporting the dipole-type second radiating element 13. At this time, a feeding signal for feeding power to the second radiating element 13 may be typically provided through the second feeding line 132, like the feeding method of the dipole-type radiating element. The second feeding line 132 may be constituted by the feeding cable structure or the strip line structure for signal coupling. The second feeding line 132, like is the typical feeding method for the dipole-type radiating element. The second feeding line 132 may extend to a back surface of the reflecting plate 1 via through holes formed on the reflecting plate 1 (first radiating element 14) and may be configured to be connected to a feeding cable at a point indicated by "a" in FIG. 5 on the back surface of the reflecting plate 1.

In the above configuration, each of the four strip lines for signal coupling, which provides a feeding signal to the patch-type first radiating element 14 by a coupling method, has feeding paths to receive feeding signals respectively through a feeding circuit board 16 on which a feeding conductor pattern is formed, according to the features of the present invention. Similarly, the feeding path may be implemented by a strip line.

At this time, the feeding circuit board 16 is fixed to an appropriate area on a front surface of the reflecting plate 1 on which the radiating elements are installed, not on the back surface of the reflecting plate 1, according to the features of the present invention. The feeding circuit board 16 may be fixed to the reflecting plate 1 by a screw fastening structure, soldering, or the like. Typically, the front surface of the reflecting plate 1 has a relatively large space between the installation spaces of the radiating elements, such that there is no difficulty in securing a space for installing the feeding circuit board 16 and an additional installation space is not required.

Figure 6:
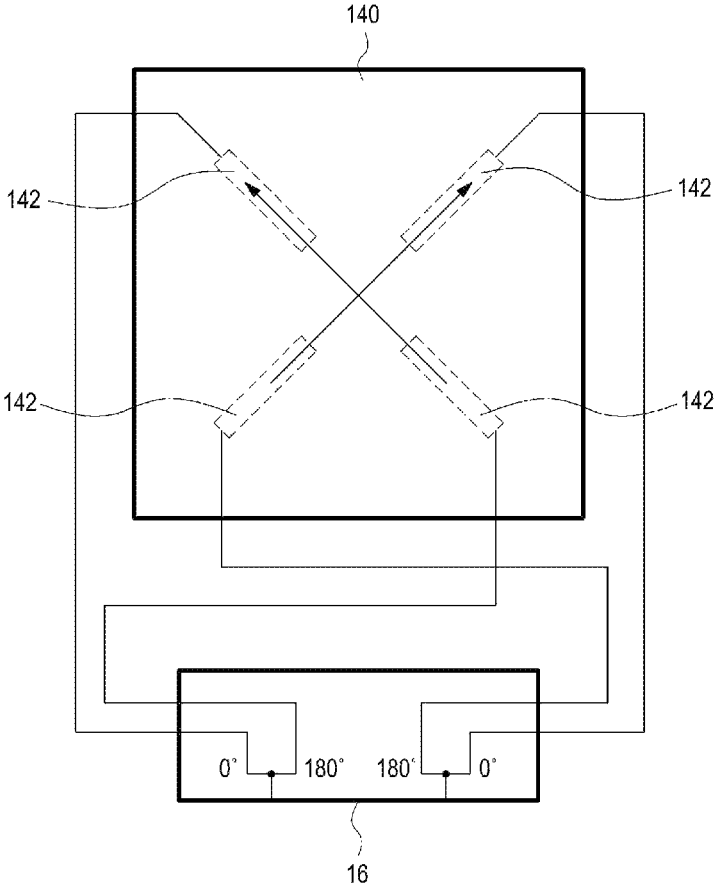
FIG. 6 is a view schematically showing a feeding method of the first radiating element of FIG. 4.

FIG. 6 is a view schematically showing a feeding method of the first radiating element of FIG. 4. Referring to FIG. 6, a method of forming a feeding conductor pattern on the feeding circuit board 16 will be described. Among four first feeding lines 142, that is, four strip lines for signal coupling that are slightly spaced apart from each other on the lower portion of the patch plate 140 and arranged in an X shape, the strip lines located in a diagonal direction to each other makes a pair to generate one polarization among dual polarizations in an X shape, respectively.

Accordingly, a feeding pattern is formed on the feeding circuit board 16 so as to distribute the feeding signal between the strip lines for signal coupling that make a pair. At this time, the feeding pattern having an appropriate length and pattern is formed on the feeding circuit board 16 so that the feeding signals transmitted between one pair of strip lines for signal coupling have a phase difference of 180° to each other. Similarly, the feeding pattern of the feeding circuit board 16 is formed so that the feeding signals transmitted between the other pair of strip lines for signal coupling also have a phase difference of 180° to each other.

Figure 7:
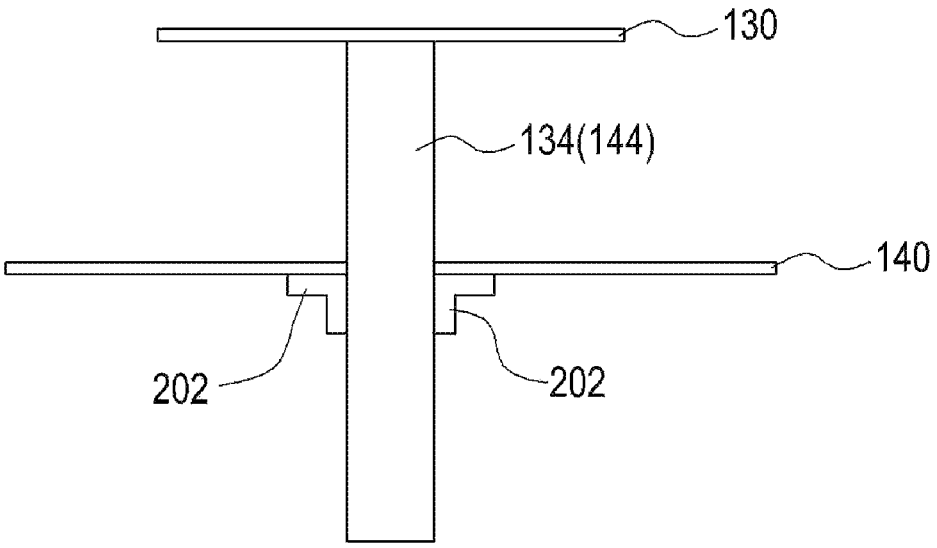
FIG. 7 is a view showing a first exemplary structure for a coupling method between the first radiating element and a second radiating element in FIG. 4.

FIG. 7 is a view showing a first exemplary structure for a coupling method between the first radiating element and a second radiating element in FIG. 4 Referring to FIG. 7, the balun supports 134 and 144 for supporting and coupling the first radiating element 14 and the second radiating element 13 may be integrally formed as a single structure on the whole. A center of the first radiating element 14 is provided with through holes corresponding to end surfaces of the balun supports 134 and 144 which may be formed integrally and thus the first radiating element 14 may be installed to be inserted into the balun supports 134 and 144. At this time, the second radiating element 13 may be fixed to the balun supports 134 and 144 by screw fastening, or the like. An example of FIG. 7 shows an additional supporting structure 202 for fixedly supporting the second radiating element 13 at an appropriate position. By the support structure, the second radiating element 13 may be fixed to the balun supports 134 and 144 by the screw fastening, or the like. It may be appreciated that the structure may be a very convenient structure when the first radiating element 14 and the second radiating element 13 need to be stacked.

Figure 8:
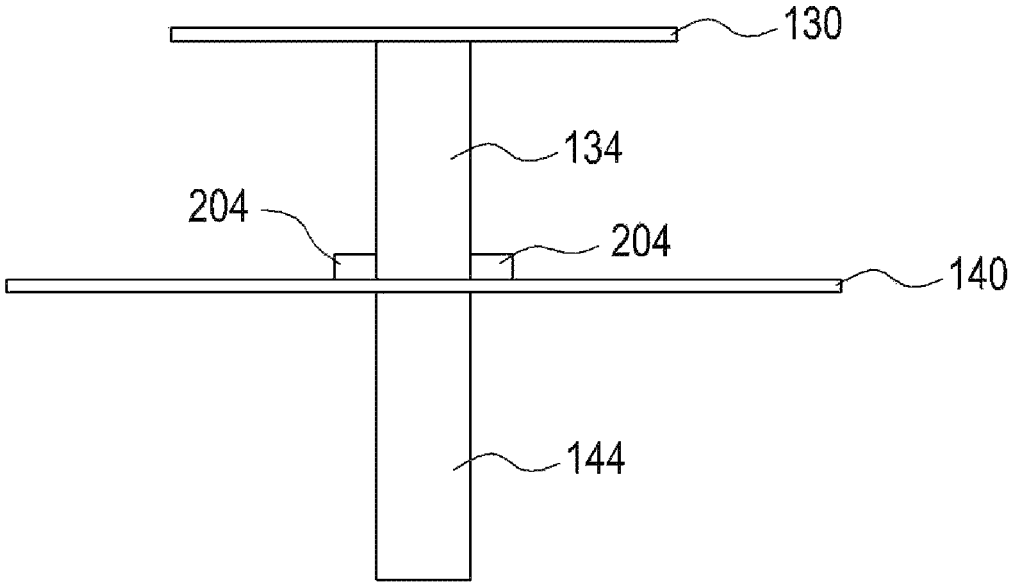
FIG. 8 is a view showing a second exemplary structure for the coupling method between the first radiating element and the second radiating element in FIG. 4.

FIG. 8 is a view showing a second exemplary structure for the coupling method between the first radiating element and the second radiating element in FIG. 4. Referring to FIG. 8, the balun supports 134 and 144 for supporting and coupling the first radiating element 14 and the second radiating element 13 may also be separately formed as the upper balun support 134 and the lower balun support 144. That is, the lower balun support 144 may fixedly support the first radiating element 14 and the upper balun support 134 may be fixedly installed on the first radiating element 14. At this time, the upper balun support 134 may be fixedly installed on the first radiating element 14 by the screw fastening, or the like. The example of FIG. 8 shows that an additional support structure 204 is provided for fixedly supporting the upper balun support 134 on the first radiating element 14.

As described above, the structure of the base station antenna according to the first embodiment of the present invention shown in FIGS. 4 to 8 has a relatively simple structure since it has a structure in which the dipole-type second radiating element 13 is stacked on the patch-type first radiating element 14. For example, the first radiating element 14 and the second radiating element 13 may be simply supported and fixed by using the balun supports 144 and 134 that may be formed integrally.

Further, in this case, since the feeding circuit board 16 for feeding the patch-type first radiating element 14 is installed on the front face of the reflecting plate 1, a relative extra space may be generated on the back surface of the reflecting plate 1. This makes it possible to more optimize the overall antenna size and to easily secure an installation space for various signal processing equipments such as a phase shifter installed on the back surface of the reflecting plate 1.

Figure 9:
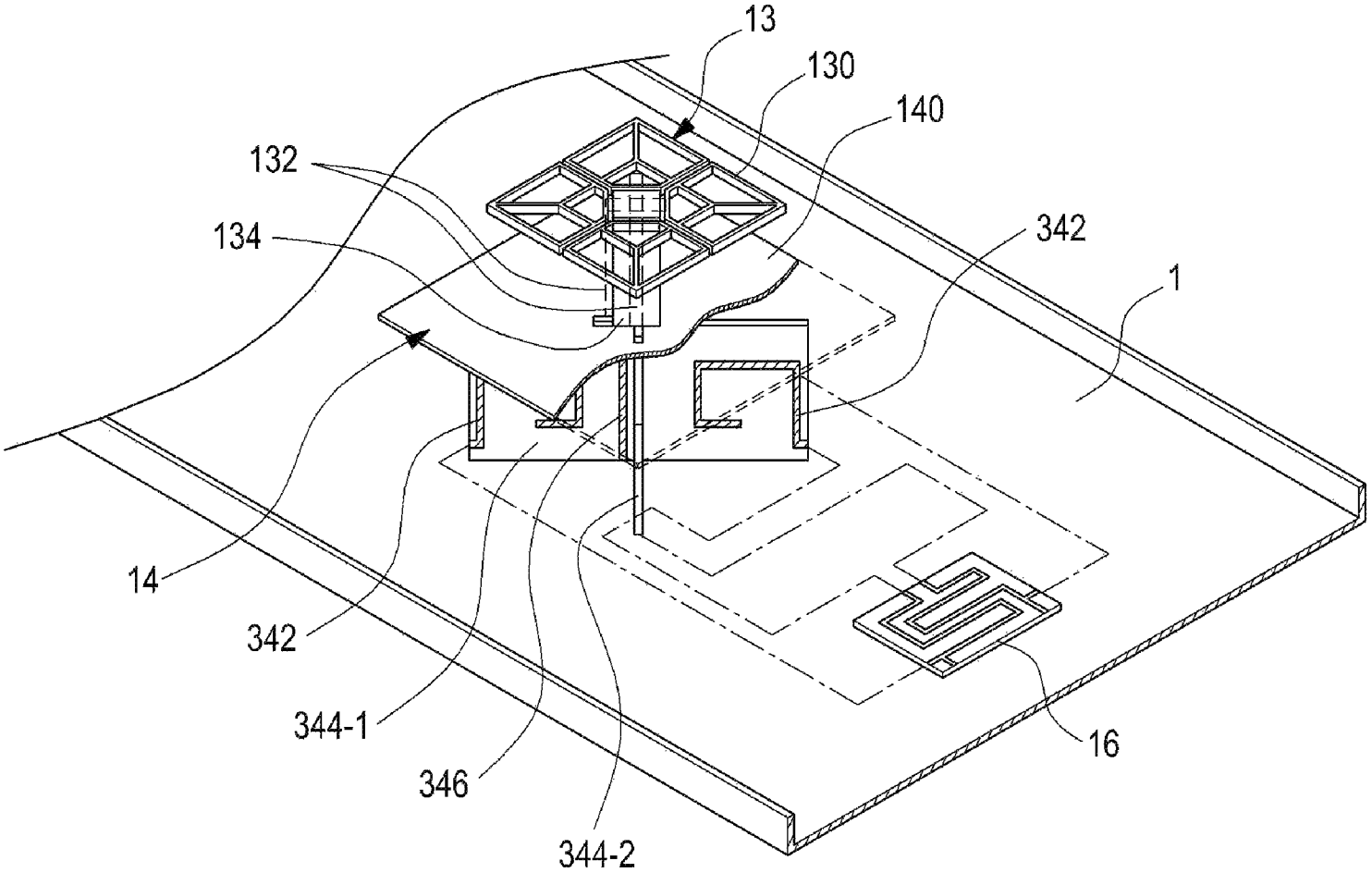
FIG. 9 is a perspective view of a dual-band dual-polarized mobile communication base station antenna according to a second embodiment of the present invention.
Figure 10:
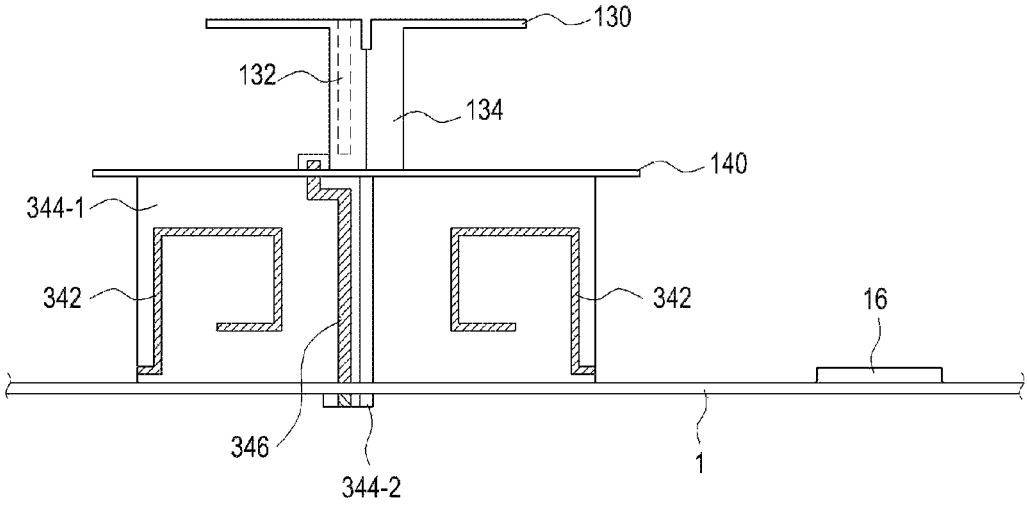
FIG. 10 is a side view of FIG. 9.
Figure 11:
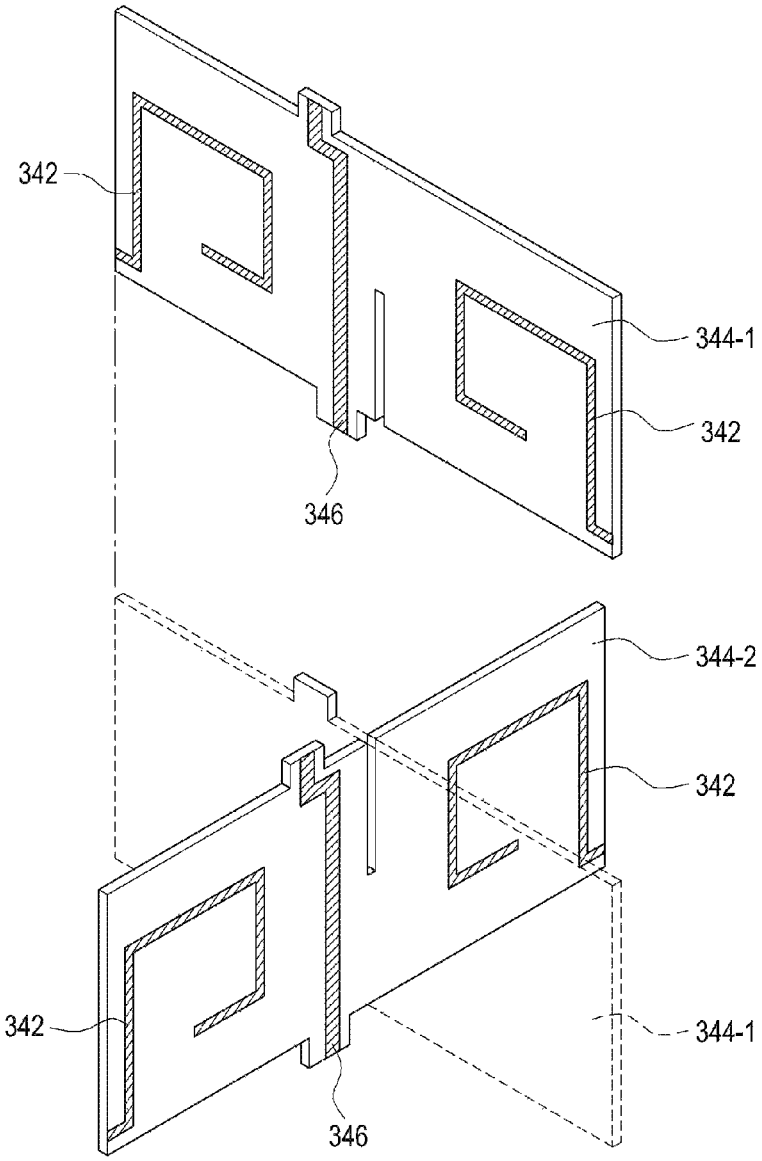
FIG. 11 is a detailed structure view of a circuit board for signal coupling of FIG. 9.

FIG. 9 is a perspective view of a dual-band dual-polarized mobile communication base station antenna according to a second embodiment of the present invention, FIG. 10 is a side view of FIG. 9, and FIG. 11 is a detailed structure view of a circuit board for signal coupling of FIG. 9. Referring to FIGS. 9 to 11, like the structure of the first embodiment shown in FIGS. 4 to 8, a base station antenna according to a second embodiment of the present invention includes a reflecting plate 1, a patch-type first radiating element 14 installed on the reflecting plate 1, and a dipole-type second radiating element 13 that is installed to be stacked on the first radiating element 14. At this time, the second radiating element 13 may have a structure supported by the balun support 136 similar to the structure of the first embodiment, and the first radiating element 14 according to the second embodiment may have a structure supported by a circuit board 344 (344-1, 344-2) for signal coupling.

That is, a patch plate 140 that generates a radio frequency of the corresponding frequency band of the patch-type first radiating element 14 is coupled in an upright form, and thus the overall plane form is supported by the circuit board 344 for signal coupling installed in an X shape. As shown in more detail in FIG. 11, the circuit board 344 for signal coupling may be configured to maintain a mutual upright form by coupling two circuit boards having an upright rectangular form, i.e., a first circuit board 344-1 for signal coupling and a second circuit board 344-2 for signal coupling to each other. At this case, the coupled state of the first and second circuit boards 344-1 and 344-2 for signal coupling may be more firmly maintained by installing groove structures engaged with each other on side surfaces corresponding to each other at a central point thereof.

Meanwhile, in addition to the structure, the circuit board 344 for signal coupling may be configured by coupling four circuit boards separately manufactured. For example, the four circuit boards having a rectangular shape may be attached as to be fixed to each other at one reference point in an upright state, so that the overall plane shape has an X shape.

A plurality of line patterns 342 for signal coupling for providing a feeding signal to the patch plate 140 by a coupling method are printed on each circuit board 344 for signal coupling having the X shape. In order to provide the feeding signal to the patch plate 140 through the line pattern for signal coupling by the coupling method, the form of the line pattern 342 for signal coupling, the size of the circuit board 344 for signal coupling, or the like are appropriately designed so that the corresponding coupling signal transmission part is appropriately spaced apart from the patch plate 140. At this time, in order to support and fix the installed state of the circuit board 344 for signal coupling, for example, an appropriate form of support (not shown) formed of a synthetic material such as Teflon may be additionally installed.

On the other hand, the dipole-type second radiating element 13 may include a plurality of radiating arms 130 generating a radio frequency of the corresponding frequency band, like the existing structure. Further, the balun support 136 may also have the structure as before and may be fixedly installed on the patch plate 140 of the first radiating element 14. At this time, the balun support 136 may be fixedly installed on the first radiating element 14 by the screw fastening, or the like.

At this time, the feeding signal for feeding power to the second radiating element 13 may be generally provided through a separate feeding line 132 like the method for feeding power to the dipole-type radiating element. At this time, as shown in FIGS. 9 to 11, the feeding line 132 of the second radiating element 13 may be configured to receive the feeding signal through a line pattern 346 for signal transmission that may be formed at an appropriate portion on the circuit board 344 for signal coupling, in addition to the line pattern 342 for signal coupling.

The portion of the circuit board on which a lower end of the line pattern 346 for signal transmission is formed may have a shape extending to the back surface of the reflecting plate 1 through the through holes formed at the corresponding portion of the reflecting plate 1 and may have, for example, a structure connected to the feeding cable on the back surface of the reflecting plate 1. In addition, similarly, the portion of the circuit board on which an upper end of the line pattern 346 for signal transmission is formed may have a shape extending to the upper portion of the first radiating element 14 through the through holes formed at the portion corresponding to the patch plate 140 of the first radiating element 14 and may have, for example, a structure connected to the feeding cable on the back surface of the reflecting plate 1.

It may be appreciated that the above-mentioned structure may not only support the first radiating element 14 using the circuit board 344 for signal transmission but simultaneously transmitting the feeding signal to the second radiating element 13 and the first radiating element 14. The structure realizes the supporting structure of the first radiating element 14 and also makes it possible to simplify the complicated feeding structure of the first and second radiating elements 14 and 13.

In the above configuration, each of the four line patterns 342 for signal coupling on the circuit board 344 for signal coupling which provides the feeding signal to the patch-type first radiating element 14 by the coupling method has feeding paths to receive feeding signals respectively through the feeding circuit board 16 on which the feeding conductor pattern is formed, according to the features of the present invention, like the structure of the first embodiment. Similarly, the feeding path may be implemented by a strip line. In addition, the feeding method for each of the four line patterns 342 for signal coupling on the feeding circuit board 16 is implemented like the structure of the first embodiment.

The mobile communication base station antenna according to the embodiment of the present invention may be performed as described above. Meanwhile, the detailed embodiments are described in the description of the present invention but various changes may be practiced without departing from the scope of the present invention.

For example, although the foregoing description discloses one exemplary structure of the second radiating element, any existing type or kind of structure for the second radiating element may be adopted in the structure of the present invention with almost changing the design.

Further, the case where the feeding line of the second radiating element is installed on the back surface of the reflecting plate is described above. Alternatively, the feeding line of the second radiating element may be installed on the front surface of the reflecting plate.

Further, in addition to various structures described above, particularly, in the structure of the second embodiment, the additional support structure for more stably fixing and supporting the patch plate of the first radiating element may be provided.

The invention claimed is:

1. An antenna for a mobile communication base station, the antenna comprising:

a reflecting plate having a first upper surface and a first lower surface;

a patch plate having a second upper surface and a second lower surface, the patch plate being installed above the reflecting plate such that the first upper surface of the reflecting plate faces the second lower surface of the patch plate, wherein the patch plate is configured to radiate a first signal having a first frequency of a first frequency band;

a plurality of radiating arms installed above the patch plate;

a circuit board for feeding, wherein the circuit board for feeding is attached to the first upper surface of the reflecting plate and is provided with a feeding conductor pattern for providing a feeding signal to the patch plate;

a set of feeding lines located below the patch plate and spaced apart therefrom at regular intervals, disposed in an X shape on the whole, and comprises a plurality of strip lines for signal coupling to provide at least one feeding signal to the patch plate, respectively; and a circuit board for signal coupling, wherein the circuit board for signal coupling stands upright from the first upper surface of the reflecting plate toward the second lower surface of the patch plate, and at least some of the plurality of strip lines are provided on the circuit board for signal coupling, wherein at least some of the plurality of strip lines are spaced apart from the reflecting plate and above thereof and also spaced apart from the patch plate and below thereof, and wherein the circuit board for feeding provides the feeding signal to the plurality of strip lines for signal coupling, respectively.

2. The antenna of claim 1, further comprising:

a balun support to support the patch plate and the plurality of radiating arms, wherein the balun support is integrally formed on the whole.

3. The antenna of claim 1, wherein the circuit board signal coupling is disposed in a X shape, and wherein a portion corresponding to each end in the X shape of the circuit board for signal coupling is printed with a plurality of line patterns for signal coupling to provide a feeding signal to the patch plate, respectively.

4. The antenna of claim 3, wherein the circuit board for signal coupling is printed with a line pattern for signal transmission for transmitting a feeding signal to the plurality of radiating arms.

5. The antenna of claim 1, wherein the circuit board for feeding is provided with feeding patterns so that a pair of strip lines for signal coupling located at a diagonal line to each other distribute a feeding signal and the feeding signal transmitted between the pair of strip lines for signal coupling has a phase difference of 180° to each other.

6. A base station comprising an antenna, wherein the antenna comprises:

a reflecting plate having a first upper surface and a first lower surface;

a patch plate having a second upper surface and a second lower surface, the patch plate being installed above the reflecting plate such that the first upper surface of the reflecting plate faces the second lower surface of the patch plate, wherein the patch plate is configured to radiate a first signal having a first frequency of a first frequency band;

a plurality of radiating arms installed above the patch plate, wherein the plurality of radiating arms are configured to radiate a second signal having a second frequency of a second frequency band, wherein the first frequency band is different from the second frequency band;

a circuit board for feeding, wherein the circuit board for feeding is attached to the first upper surface of the reflecting plate and is provided with a feeding conductor pattern for providing a feeding signal to the patch plate;

a set of feeding lines located below the patch plate and spaced apart therefrom at regular intervals, disposed in an X shape on the whole, and comprises a plurality of strip lines for signal coupling to provide at least one feeding signal to the patch plate, respectively; and a circuit board for signal coupling, wherein the circuit board for signal coupling stands upright from the first upper surface of the reflecting plate toward the second lower surface of the patch plate, and at least some of the plurality of strip lines are provided on the circuit board for signal coupling, wherein at least some of the plurality of strip lines are spaced apart from the reflecting plate and above thereof and also spaced apart from the patch plate and below thereof, and wherein the circuit board for feeding provides the feeding signal to the plurality of strip lines for signal coupling, respectively.

7. The base station of claim 6, wherein the antenna further comprises:

a balun support to support the patch plate and the plurality of radiating arms, wherein the balun support is integrally formed on the whole.

8. The base station of claim 6, wherein the circuit board signal coupling is disposed in a X shape, and wherein a portion corresponding to each end in the X shape of the circuit board for signal coupling is printed with a plurality of line patterns for signal coupling to provide a feeding signal to the patch plate, respectively.

9. The base station of claim 8, wherein the circuit board for signal coupling is printed with a line pattern for signal transmission for transmitting a feeding signal to the plurality of radiating arms.

10. The base station of claim 6, wherein the circuit board for feeding is provided with feeding patterns so that a pair of strip lines for signal coupling located at a diagonal line to each other distribute a feeding signal and the feeding signal transmitted between the pair of strip lines for signal coupling has a phase difference of 180° to each other.

11. A communication apparatus comprising an antenna, wherein the antenna comprises:

a reflecting plate having a first upper surface and a first lower surface;

a patch plate having a second upper surface and a second lower surface, the patch plate being installed above the reflecting plate such that the first upper surface of the reflecting plate faces the second lower surface of the patch plate, wherein the patch plate is configured to radiate a first signal having a first frequency of a first frequency band;

a plurality of radiating arms installed above the patch plate, wherein the plurality of radiating arms are configured to radiate a second signal having a second frequency of a second frequency band, wherein the first frequency band is different from the second frequency band;

a circuit board for feeding, wherein the circuit board for feeding is attached to the first upper surface of the reflecting plate and is provided with a feeding conductor pattern for providing a feeding signal to the patch plate;

a set of feeding lines located below the patch plate and spaced apart therefrom at regular intervals, disposed in an X shape on the whole, and comprises a plurality of strip lines for signal coupling to provide at least one feeding signal to the patch plate, respectively; and a circuit board for signal coupling, wherein the circuit board for signal coupling stands upright from the first upper surface of the reflecting plate toward the second lower surface of the patch plate, and at least some of the plurality of strip lines are provided on the circuit board for signal coupling, wherein at least some of the plurality of strip lines are spaced apart from the reflecting plate and above thereof and also spaced apart from the patch plate and below thereof, and wherein the first-circuit board for feeding provides the feeding signal to the plurality of strip lines for signal coupling, respectively.

12. The communication apparatus of claim 11, wherein the antenna further comprises:

a balun support to support the patch plate and the plurality of radiating arms, wherein the balun support is integrally formed on the whole.

13. The communication apparatus of claim 11, wherein the circuit board signal coupling is disposed in a X shape, and wherein a portion corresponding to each end in the X shape of the circuit board for signal coupling is printed with a plurality of line patterns for signal coupling to provide a feeding signal to the patch plate, respectively.

14. The communication apparatus of claim 13, wherein the circuit board for signal coupling is printed with a line pattern for signal transmission for transmitting a feeding signal to the plurality of radiating arms.

15. The communication apparatus of claim 11, wherein the circuit board for feeding is provided with feeding patterns so that a pair of strip lines for signal coupling located at a diagonal line to each other distribute a feeding signal and the feeding signal transmitted between the pair of strip lines for signal coupling has a phase difference of 180° to each other.

* * * * *